US007322395B2

(12) United States Patent
Nyffenegger et al.

(10) Patent No.: US 7,322,395 B2
(45) Date of Patent: Jan. 29, 2008

(54) TAMBOUR DOOR COMPRISING A DOOR LEAF THAT CAN BE ROLLED UP AND USES THEREOF

(75) Inventors: Jürg Nyffenegger, Schwarzenburg (CH); Erich Kaufmann, Schwarzenburg (CH); Pascal Bürki, Schwarzenburg (CH)

(73) Assignee: Kaba Gilgen AG, Schwarzenburg (CH)

( * ) Notice: Subject to any disclaimer, the term of this patent is extended or adjusted under 35 U.S.C. 154(b) by 254 days.

(21) Appl. No.: 10/520,640

(22) PCT Filed: Jun. 13, 2003

(86) PCT No.: PCT/CH03/00382

§ 371 (c)(1),
(2), (4) Date: Jan. 7, 2005

(87) PCT Pub. No.: WO2004/007890

PCT Pub. Date: Jan. 22, 2004

(65) Prior Publication Data

US 2005/0274462 A1 Dec. 15, 2005

(30) Foreign Application Priority Data

Jul. 11, 2002 (CH) ..... 1222/02

(51) Int. Cl.
*E06B 9/11* (2006.01)

(52) U.S. Cl. ..... 160/31; 160/265; 160/310; 160/343

(58) Field of Classification Search ..... 160/23.1, 160/31, 271, 273.1, 265, 310, 311, 343, 318, 160/315, 313
See application file for complete search history.

(56) References Cited

U.S. PATENT DOCUMENTS 490,448 A 1/1893 Lugrin
3,074,474 A * 1/1963 Dunn ..... 160/23.1
3,774,665 A * 11/1973 Bourne ..... 160/343

(Continued)

FOREIGN PATENT DOCUMENTS

EP 0 149 138 A3 7/1985

(Continued)

*Primary Examiner*—David Purol
(74) *Attorney, Agent, or Firm*—The Webb Law Firm

(57) ABSTRACT

Disclosed is a tambour door comprising a door leaf that can be rolled up. The door comprises a vertical roller frame for receiving the door leaf, a sliding bar, to which the rollable door leaf is fixed, and an upper horizontal guide rail, in which the sliding bar is displaceably mounted. The invention facilitates a particularly simple, space-saving, modular construction. The rear face or external face of the roller frame is fixed to a wall and the guide rail is configured as a floating guide rail, which is fixed on one side at least indirectly to the roller frame and on the other side in a fixing element that is fastened at least indirectly to a wall. The door can be used as a lavatory door, or in situations requiring privacy protection for a door opening that economizes on space as much as possible.

18 Claims, 9 Drawing Sheets

U.S. PATENT DOCUMENTS

| | | | | |
|---|---|---|---|---|
| 4,096,902 | A | 6/1978 | Junod | |
| 4,821,786 | A * | 4/1989 | Johnston | 160/23.1 |
| 5,139,075 | A * | 8/1992 | Desrochers | 160/310 |
| 5,505,244 | A * | 4/1996 | Thumann | 160/23.1 |
| 6,024,156 | A * | 2/2000 | Chu | 160/331 |
| 6,059,007 | A * | 5/2000 | Tomita | 160/242 |
| 6,070,642 | A * | 6/2000 | Douglas et al. | 160/310 |
| 6,082,432 | A * | 7/2000 | Kissinger | 160/290.1 |
| 6,478,070 | B2 * | 11/2002 | Poppema | 160/23.1 |
| 6,595,262 | B2 * | 7/2003 | Chen | 160/23.1 |
| 6,629,555 | B2 * | 10/2003 | DeBlock et al. | 160/31 |
| 2001/0030028 | A1 | 10/2001 | Poppema | |

FOREIGN PATENT DOCUMENTS

| | | |
|---|---|---|
| EP | 1 211 379 A2 | 6/2002 |

* cited by examiner

TAMBOUR DOOR COMPRISING A DOOR LEAF THAT CAN BE ROLLED UP AND USES THEREOF

BACKGROUND OF THE INVENTION

1. Technical Field

The present invention relates to a rolling door having a door leaf which can be rolled up, and to a method of installing the same.

2. Description of Related Art

Rolling doors are used nowadays in particular in the industrial sector if the intention is for a door opening to be opened quickly and, if appropriate, automatically. It is possible here for the door opening to be closed in the vertical or horizontal direction.

Thus, for example, EP 0149138 describes an automatic door with two door parts made of roll-up sheets which, for the purpose of the closing and opening operations, can be moved symmetrically in relation to one another in the horizontal direction and are rolled up on rollers. U.S. Pat. No. 4,096,902 describes a similar rolling door in which the sheets are moved via a mechanism using a toothed belt. A further rolling door is described in U.S. Pat. No. 490,448, in which it is possible for a single door leaf comprising segments to be moved via a high-outlay cable mechanism.

SUMMARY OF THE INVENTION

Accordingly, the object of the invention is to provide a rolling door which is cost-effective to produce, does not take up much space and is straightforward to construct and activate, this in conjunction with a rolling door having a door leaf which can be rolled up, having a vertical roller casing for accommodating the door leaf, having a sliding bar which can be displaced in the horizontal direction and on which the roll-up door leaf is fastened, and having a horizontal guide rail which is located at the top and in which the sliding bar is mounted in a displaceable manner.

This object is achieved in that the roller casing is or can be fastened on a wall by way of its rear side or its outer side, and the guide rail is designed as a free guide rail which is fastened, on one side, at least indirectly on the roller casing and, on the other side, in a holder attached at least indirectly to a wall.

The core of the invention is thus to provide a simplified construction using a free guide rail, i.e. a guide rail which is only fastened or secured at its ends. On one side, in this case, the guide rail is fastened at least indirectly on the roller casing, i.e. it is sufficient to fasten the roller casing on the wall on the one side and to fit the holder on the other side. In particular a rolling door according to the invention proves to be advantageous when, for example in the case of toilet cubicles, there is no lintel present. The straightforward modular construction allows cost-effective production of the individual parts and installation of the rolling door which does not require high outlay. Moreover, the construction proposed allows the guide rail to be adapted to the inside width of the door simply by means of cutting to length. This is made possible in that the guide rail is fastened, on both sides, in holders which allow a certain amount of tolerance for the length of the guide rail. The production of different lengths of guide rails can thus largely be done away with. The bottom edge of the rolling door, which is exposed as a result of the door being guided exclusively at the top edge, can be spaced apart from the floor, as a result of which, and this may be important in particular if the door is used as a toilet door, it is easier to clean the door region and good ventilation of the interior is made possible.

A first preferred embodiment of the rolling door according to the invention is distinguished in that the guide rail is designed as a hollow profile, a pulling carriage with running rollers preferably being mounted in a displaceable manner in the hollow profile, and the hollow profile also preferably having exclusively a slot which is open in the downward direction and through which the pulling carriage is connected to the sliding bar. It is possible here, in particular, for the guide rail to be configured as a tube of essentially circular cross section, and for the pulling carriage to comprise at least one pair, in particular preferably two pairs arranged one behind the other, of running rollers which are arranged to the sides of the pulling carriage, have a curved running surface and on which inner surfaces of the tube which are present alongside the slot run. Using a straightforward tube as the guide rail proves to be particularly favorable in production terms and results in a pleasing appearance. The curved inner running surfaces which are thus available can be used to good effect in combination with curved running surfaces of the running rollers.

A further preferred embodiment of the rolling door is characterized in that a motor for displacing the sliding bar is arranged in or on the roller casing, and in that this displacement takes place via a spindle which is driven by the motor. The spindle here is preferably arranged in the interior of the guide rail and engages in at least one internal thread in the pulling carriage, this thread being adapted to the characteristics of the spindle. It proves to be advantageous here if the spindle, on the side which is directed away from the roller casing, is mounted in the holder. Using a spindle for moving the sliding bar proves to be very reliable and to save a lot of space and, moreover, such a design is easy to realize. It is also possible here for the axis of the motor to be arranged perpendicularly to the plane of the door on or in the roller casing and for power to be transmitted to the spindle via an angular gear mechanism. The braking functions which are necessary, inter alia, for safety reasons, are preferably arranged, in particular, along with the motor, rather than with the gear mechanism, in order for the associated step-up transmission to be utilized. The spindle is preferably inserted into an internally threaded (blind) hole provided in the motor-gear mechanism, and is fixed therein via a locking screw. It is thus easily possible to compensate for inaccuracies in length which arise when the spindle is cut to length.

Another embodiment of the rolling door, furthermore, has a counter-profile on that side of the door which is located opposite the roller casing. This counter-profile is fastened on a wall and is designed for stopping the sliding bar when the door is closed. Correspondingly, it is possible for the counter-profile to be adapted in shaping to the front edge of the sliding bar, in order to effect the best possible sealing when the door is closed (this can take place, for example, via a seal which is arranged on the front edge of the sliding bar and has a specific profile which engages in a corresponding profile in the counter-profile). As an alternative, however, it is also possible for the sliding bar simply to be guided behind a wall protrusion. It is preferable here for the holder for the guide rail to be designed as a top covering for this counter-profile and to be connected firmly thereto. In other words, rather than the holder being fastened directly on the wall, in the first instance the counter-profile is screwed on and then the holder is positioned on the counter-profile from above as a covering. This modular construction may prove to be advantageous for installation purposes.

For controlling or actuating the door (opening or closing), according to another embodiment of the invention, a switch for the contactless operation of the rolling door is arranged on the roller casing, preferably on its inner side, which is arranged perpendicularly to the plane of the door leaf (in order to avoid the situation where, e.g. if used as a toilet door, the door is opened accidentally). The contactless switch proves to be advantageous, in particular, in terms of hygiene. This switch is preferably designed as a single switch which activates the motor logically in each case in dependence on the position of the door leaf. This means that, when the door is closed, activation of the switch automatically opens the door and that, when the door is open, activation of the switch automatically causes the door to be closed.

For safety reasons, it may be advantageous, according to another preferred embodiment, to provide the sliding bar with a mechanism which allows the sliding bar to tilt if, when the rolling door is being closed, an obstacle is located in the inside width of the door. It is possible here for the mechanism to be designed, for example, as a bar or fork which is arranged vertically and connected rigidly to the pulling carriage and is attached to the sliding bar via a pivot pin arranged perpendicularly to the door leaf. This pivot pin is preferably arranged in the top third of the sliding bar, and means are provided for fixing the sliding bar in a vertical position and for releasing the same such that it can be rotated about the pin only when a certain leverage about this pin is exceeded.

The operation of securing the roll-up door leaf can be realized by the roller casing containing a roller body onto which the roll-up door leaf is rolled, the roller body containing a torsion spring such that, when the door leaf is being closed, it is unwound from the roller body counter to the spring force, and the energy which is built up in the process, in particular, is preferably sufficient for rolling up the door leaf onto the roller body again, without any further motor power, when the rolling door is opened. Such a mechanism proves to be advantageous particularly in respect of the door being opened in an emergency (e.g. also in the event of power failure).

Such a rolling door may have an exchangeable roll-up door leaf or an exchangeable roller body, in order that the door surface, which can be used for example for advertising purposes, is easy to exchange or, in the case of a defect, to replace. The door leaf may be formed from at least partially textile woven fabric, possibilities here being, in particular, laminates made of plastics and woven fabrics. Depending on requirements, the material has different properties, e.g. coloring, surface configuration, resistance to chemicals, etc. The surface, moreover, can have printing applied to it and can be used correspondingly for advertising graphics or the like. The advertising graphics thus appear each time the door is closed and disappear again when the door is opened. The default position is normally that in which the door is open.

The present invention also relates to the use of a rolling door as described above as straightforward interior shutters, e.g. for furniture and pieces of equipment, as a toilet door, a door for changing cubicles, talk booths such as phone booths, as photo booths, or as a partition door in or on public transport. It proves to be advantageous for these uses, in particular, as a result of its space-saving construction (no pivoting region, thus, for example, more toilet cubicles per square meter, possible straightforward provision of toilet cubicles for the disabled). In quite general terms, it is thus possible to use this door in situations where a door opening is to be provided in as space-saving a manner as possible, in particular, with a screen.

The present invention further relates to a method of installing a rolling door as described above. In particular here, the roller casing is fastened on a wall on one side of the door opening, thereafter the guide rail and, if appropriate, the spindle are cut to a length corresponding to the inside width of the door opening, and then the holder or, if appropriate, the counter-profile, on which the holder is fastened, is fastened on the other side of the door opening, the guide rail and also, if one is present, the spindle being fastened between the roller casing and holder.

BRIEF DESCRIPTION OF THE FIGURES

The invention will be explained in more detail hereinbelow, with reference to exemplary embodiments, in conjunction with the drawing, in which.

DETAILED DESCRIPTION OF THE INVENTION

Figure 1:
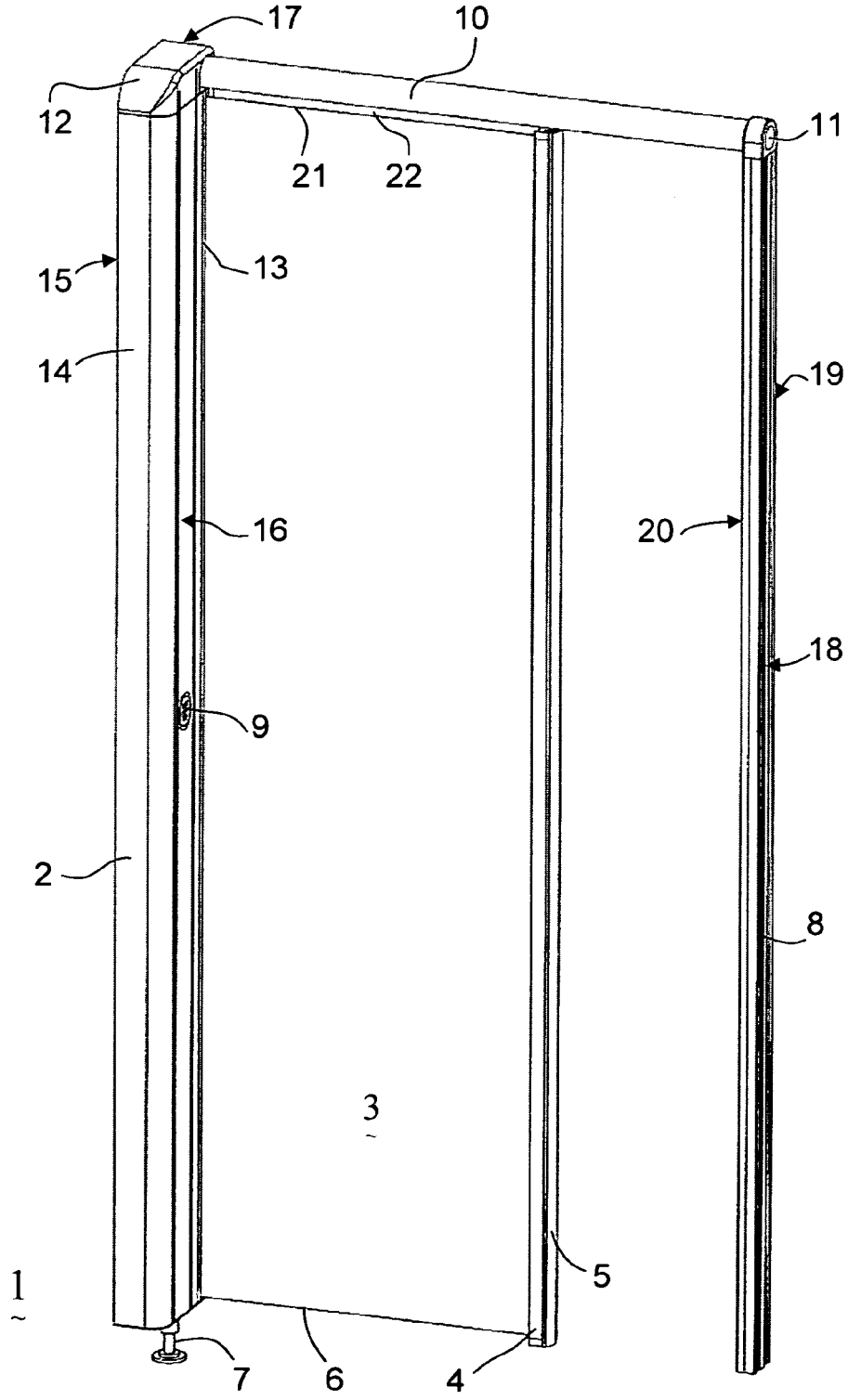
FIG. 1 shows a perspective view of a rolling door in a half-closed position.

FIG. 1 shows a perspective view of an exemplary embodiment of a rolling door 1. In specific terms, this is a door for a toilet cubicle. Partition walls are arranged here to the right and left of the door opening (essentially only as a screen, not depicted); a door lintel, on the other hand, is not present. On one side, the roller casing 2 is arranged in the vertical direction. The roller casing 2 has a front side 14, which is directed toward the interior of the toilet cubicle. It is also has an outer side 15, an inner side 16, which is directed toward the door opening, and a rear side 17. It is possible for the roller casing 2 either to have its outer side 15 fastened on a side wall of the toilet cubicle or to have its rear side 17 fitted on a wall part which is arranged parallel to the plane of the door opening (end-side installation). The fastening using the outer side 15 proves to be particularly advantageous, in particular, when the individual cubicles are only separated from one another by partition walls which are arranged perpendicularly to the plane of the door opening. The roller casing 2 may (optionally) be supported on the floor via a supporting foot 7. At its top end, the roller casing is provided with a top covering 12. The drive means are arranged beneath the covering 12. The roller casing serves for accommodating the roller body and thus provides the necessary barrier to access. The control and operating elements are additionally accommodated in this casing.

A guide rail 10 is arranged at right angles to the roller casing 2 and above the door opening. A vertically arranged counter-profile 8 is located on that side of the door opening which is located opposite the roller casing 2. It is possible for this counter-profile 8 either to have its rear side 19 screwed firmly to a wall arranged parallel to the plane of the door opening (end-side installation) or, in particular if only partition walls are provided, as has been mentioned above, to have the outer side 18 fastened on such a partition wall, which is arranged perpendicularly to the plane of the door opening. The counter-profile 8 is covered by a holder 11 at its top end. This holder 11 serves simultaneously as a top covering for the counter-profile 8, as a termination or guide component for the guide rail 10 and as a mount for a spindle 32 arranged in the guide rail 10.

The guide rail 10 thus has one side embedded in the holder 11. At the other, roller-casing end, the guide rail 10 is mounted in the top covering 12 or in elements arranged beneath this covering. The guide rail 10 has an essentially circular cross section, a slot being arranged on the underside, with the result that a guide element arranged in the guide rail 10 can guide the door leaf. For this purpose, the rolling door 1 also has a vertical sliding bar 4, on which a roll-up door leaf 3 is fastened, on one side, over the entire height. The sliding bar 4 has a length which corresponds essentially to the height of the sheet of the door leaf 3 and which does not reach to the floor. A spacing thus remains between the bottom edge of the sliding bar 4 or the bottom edge 6 of the door leaf 3 and the floor. The door leaf 3 is not guided on its underside, and the abovementioned spacing allows straightforward cleaning of the floor in the door region.

The roller casing 2 has, on its inner side 16, on the one hand, a lateral slot 13 which extends over essentially the entire height of the roller casing and through which the sheet of the door leaf 3 is guided. On the other hand, a switch 9 is arranged on the inner side 16, approximately half way up the latter or at a somewhat lower level. Via this switch 9, which is designed as a contactless switch, it is possible to activate the opening or closing operation of the door. The switch 9 is realized in a single printed circuit board and can be triggered if approached at a distance of a few cm. It may be triggered here, for example, optically. A logic circuit which activates the motor in accordance with the closure state of the door is provided here. In other words, proximity to the switch when the door is closed opens the door, whereas proximity to the switch when the door is open causes the door to be closed. Arranging the switch 9 on the inner side 16 of the roller casing 2 (i.e. on the side of the roller) together with the sensitivity within a range of not more than 10 cm proves to be advantageous since, in particular if the door is a toilet door, it is thus possible to prevent the door from being opened accidentally, for example when someone is undressing. In order also to prevent the possibility of the door being closed from the outside by reaching through the door opening without someone being present inside the cubicle, the logic circuitry, moreover, is designed such that the hand has to be held in front of the switch 9 at least within the first two seconds of the closing operation (i.e. typically until the door is approximately at least half-closed).

Figure 2:
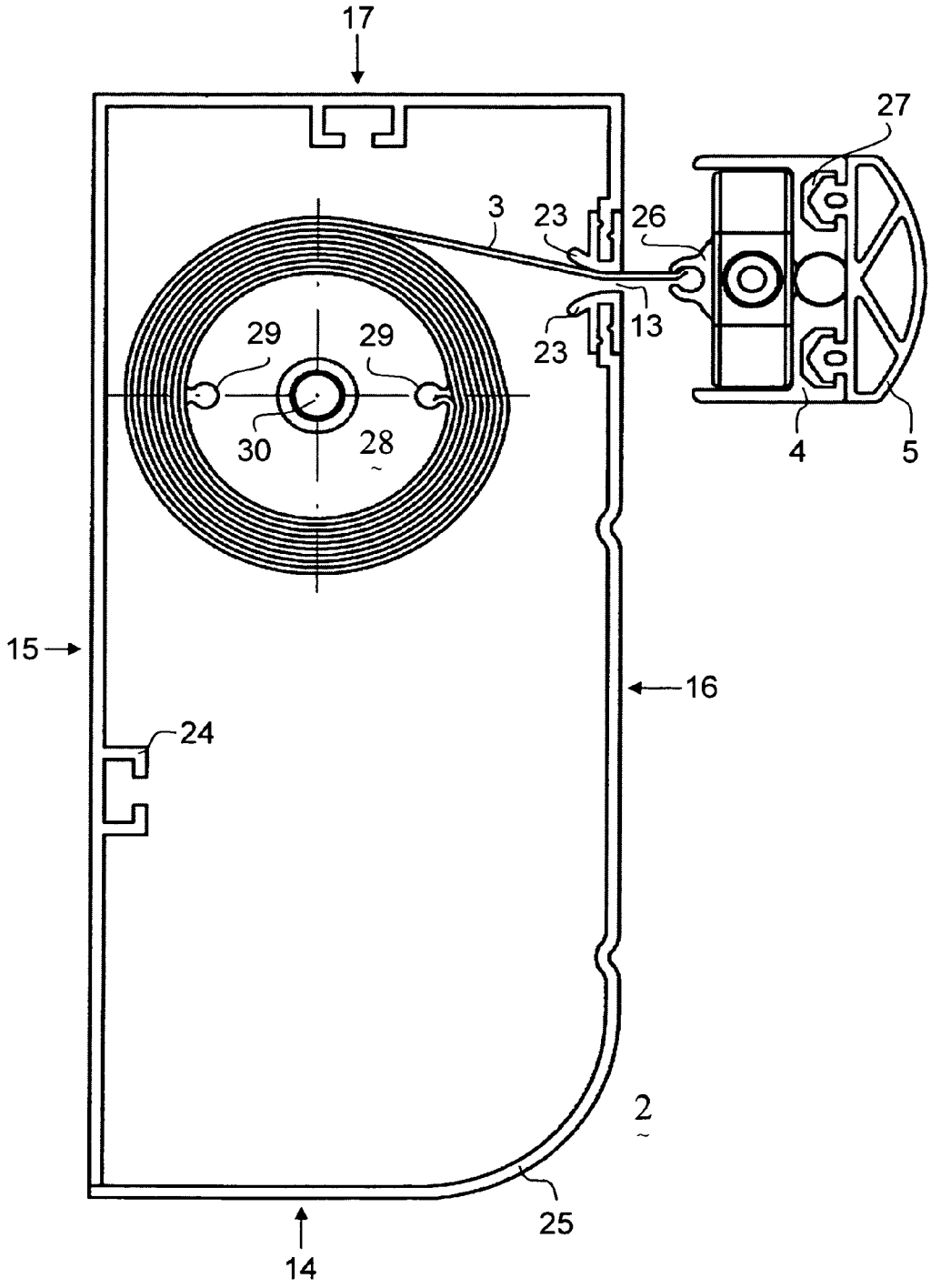
FIG. 2 shows a horizontal section through a rolling door.

FIG. 2 shows a horizontal section through the roller casing 2 in the central region with the door drawn back to the maximum extent. The roller casing 2 has a width of 8 cm and a depth of 18 cm and is produced from plastic or metal (e.g. Al, anodized). It has a rounded portion 25 in the front region. In addition, fastening profiles 24 are provided on the outer side 15 and on the rear side 17 in order to allow simplified fastening of the roller casing on a wall. Arranged vertically in the roller casing is a roller body 28 onto which the door leaf 3 can be rolled up, this roller body thus serving as a winding body for the textile. For this purpose, the roller body 28 has vertical fastening grooves 29 in which one side of the sheet of the door leaf can be fastened. The door leaf 3 is guided out of the roller casing 2 via a slot 13. For improved guidance of the door leaf 3, guide loops (e.g. made of plastic) are fastened on this slot 13, preferably on both sides, and feed the sheet in a controlled manner, in particular on the inner side of the roller casing 2, to the slot. The sliding bar 4, for its part, has a fastening groove 26 in which the sheet of the door leaf 3 is fastened on the other side, over essentially the entire height. Moreover, on the side which is directed toward the door opening, the sliding bar 4 has a seal 5 which extends over the entire length of the sliding bar 4 and is made of soft plastic (edge-protection rubber). This seal 5 is secured in the profile of the sliding bar 4 via at least one fastening protrusion 27. The seal 5 serves, on the one hand, for optimum sealing of the door in relation to the counter-profile 8 and, on the other hand, for damping purposes in the event of the sliding bar colliding with an object located in the inside width of the door. With the sliding bar 4 drawn in to the full extent, there is a spacing of approximately 12 to 13 cm between the outer side 15 of the roller casing 2 and the front edge of the sliding bar 4 or of the seal 5. This arrangement is thus extremely compact and is advantageous, in particular, even when a large door opening has to be provided (e.g. in toilets for the disabled).

Figure 3:
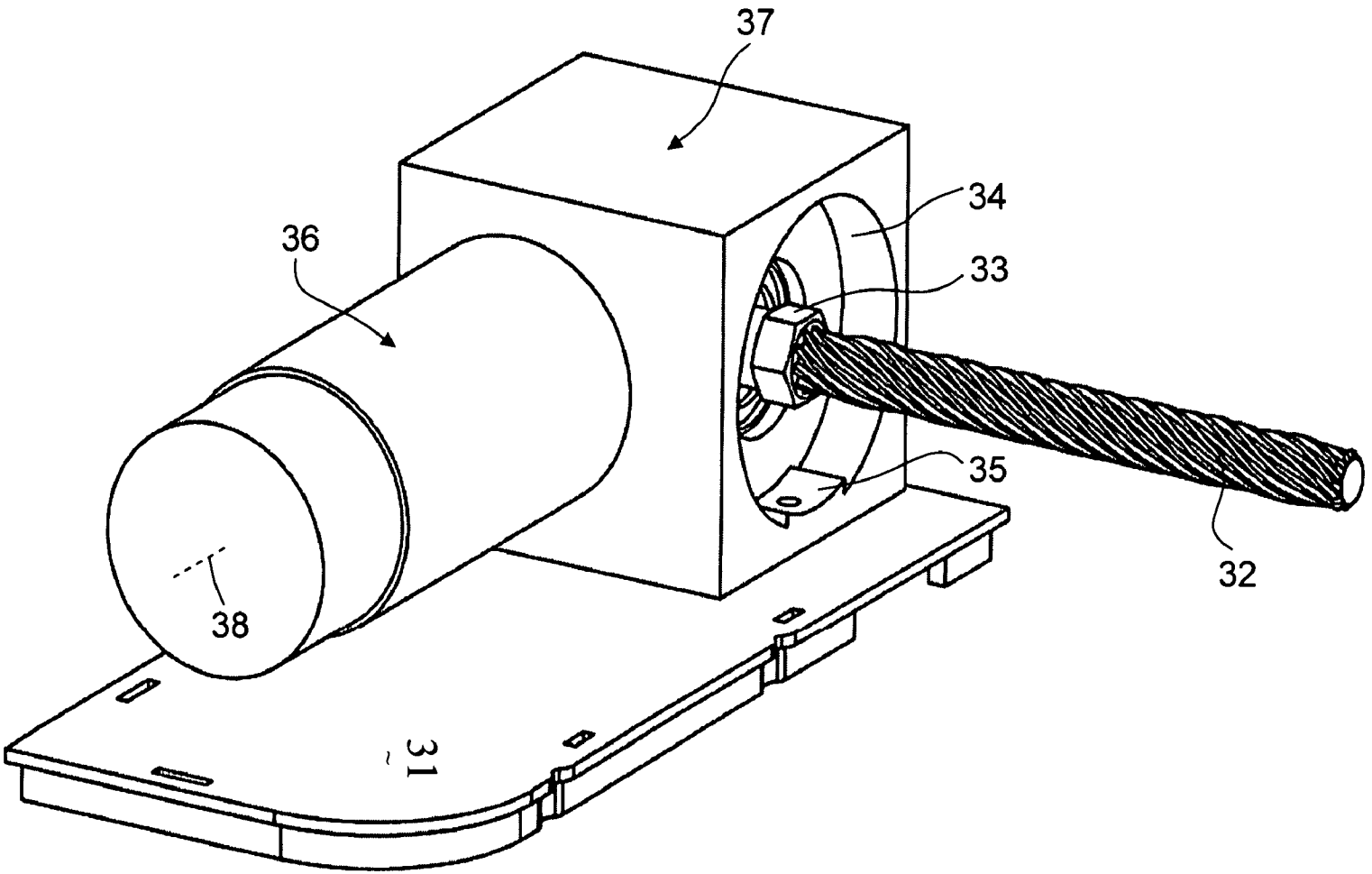
FIG. 3 shows a perspective view of the drive mechanism of the rolling door.

FIG. 3 shows a perspective view of the drive means for the rolling door, with an attachment plate 31 which can be positioned on the vertical roller-casing profile, which is open in the upward direction (see, for this purpose, the protrusions provided in the downward direction). The arrangement shown in this figure, with the door installed, is covered by the covering 12. The motor 36 is fitted on the attachment plate 31. The axis 38 of the motor 36 is arranged horizontally and in a direction perpendicular to the guide rail 10. A brake for the motor 36 is arranged beneath the end cap in the region of 38. The moment produced by the motor 36 is converted, via an angular gear mechanism 37 arranged in a casing, into a rotation about an axis parallel to the guide rail 10. A spindle 32, which is arranged in the guide rail 10, essentially along the axis of this guide rail, is driven in the process. The spindle has, for example, a pitch of 50 millimeters. It is necessary here to find a compromise between quick, controlled door movement and the lowest possible opposing force in the situation where the torsion spring, e.g. in particular in the event of emergency opening, is intended to displace the sliding bar into the open position without being assisted by the motor. The spindle 32, on this side, has an external thread at its end. The angular gear mechanism 37, for its part, for the purpose of coupling the spindle 32, has a blind hole with an internal thread for accommodating the spindle 32. The spindle is correspondingly screwed into this blind hole and then fixed therein by means of a locking screw 33. This method of fastening the spindle 32 allows a certain amount of tolerance in the length of the spindle 32 during installation. This is important, in particular, since typically different door openings are present at construction sites and, correspondingly, both the guide rail 10 and the spindle 32, which are both mounted in the holder 11 on the other side, have to be cut to length corresponding to the inside width of the door.

The sliding bar 4 is moved in the closing direction by the spindle drive. In this case, the textile is unrolled from the roller body 28. At the same time, the torsion spring integrated in the roller body is subjected to stressing. The textile is thus tensioned, without bunching, in any position.

For emergency situations, the motor also has possible means of opening the door either from the outside (e.g. by means of a square-end tool) or from the inside (e.g. by means of a lever). These possible means are of purely mechanical configuration, in order that this actuation is possible even in the event of a power failure, this being the case in that, for such an opening, essentially only a brake arranged in the region of the angular gear mechanism is released, and in that sufficient energy is stored in the torsion spring of the roller body in order to allow the rolling door to open automatically. In the event of an emergency opening, the motor rotates along in the manner of a generator and thus gives rise to a continuous opening movement (no spring-back movement). As a result of the low door-leaf weight and the disengaging mechanism of the sliding bar (which will be described at a later stage in the text), it is possible to do away with light barriers, safety strips and the like. The impact energy is thus low and cannot result in injury.

The motor-gear mechanism unit thus provides a means of mounting and driving the spindle 32. By virtue of the motor power being monitored, end positions and possible obstacles can be detected. The directly attached holding brake guarantees the secure closed position.

Figure 4:
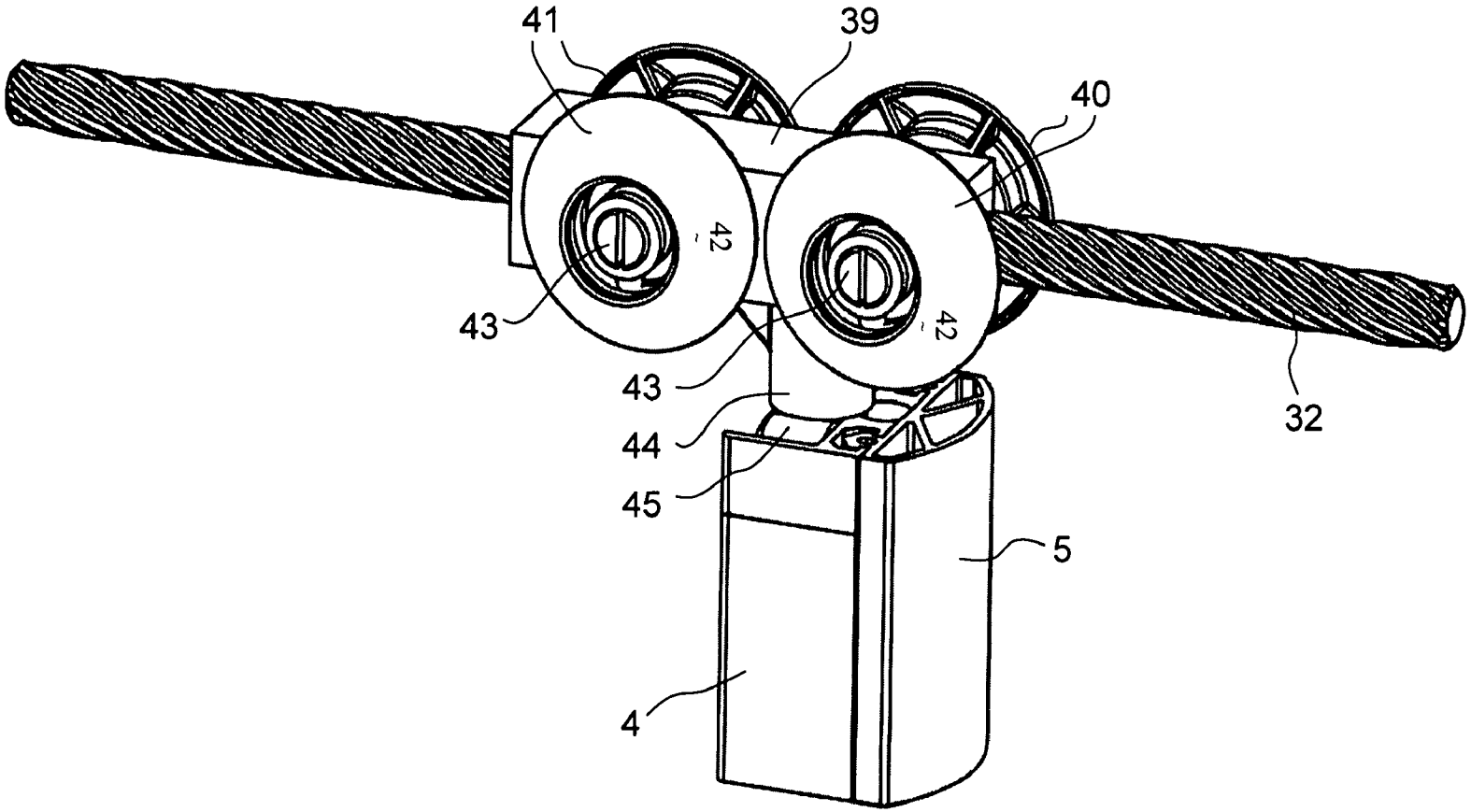
FIG. 4 shows a view of the guide carriage.

FIG. 4 illustrates the carrying mechanism for the sliding bar 4 together with the spindle 32, the guide rail 10 having been removed. A pulling carriage 39 made of plastic is located in a displaceable manner on the spindle 32. The pulling carriage has two pairs of running rollers 40 and 41 which are respectively arranged laterally and one behind the other. Using two pairs of running rollers which are arranged one behind the other and have a height corresponding essentially to the height available in the guide rail 10 means that there is no need to use the usually present counter-pressure rollers for stabilizing purposes if the pulling carriage 39 is subjected to a torque (e.g. when the sliding bar strikes against an obstacle). Since the running rollers run in the interior of the guide rail 10 with a round cross section, they have a curved running surface 42 (approximately hemispherical). The running rollers are each simply plugged onto resilient supports 43 (straightforward slotted plastic cylinders with an encircling protrusion on the outside). Fastened on the underside of the pulling carriage 39 is a vertical, rigid hollow cylinder 44, in which the sliding bar 4 is fastened.

The spindle thus moves the pulling carriage in the longitudinal direction. The guide forces which occur are transmitted to the guide rail 10 by guide rollers arranged in pairs. The semicircular geometry of the guide rollers can ideally make allowances for angle deviations and transverse movements.

Figure 5:
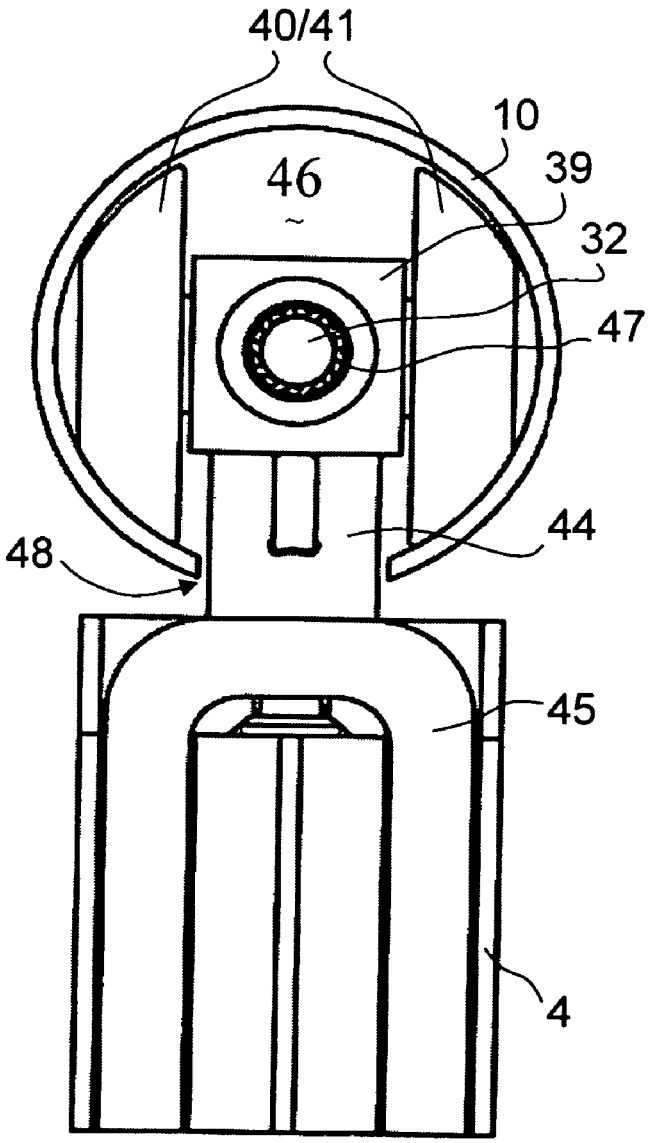
FIG. 5 shows a vertical section through the guide rail with pulling carriage.
Figure 6A:
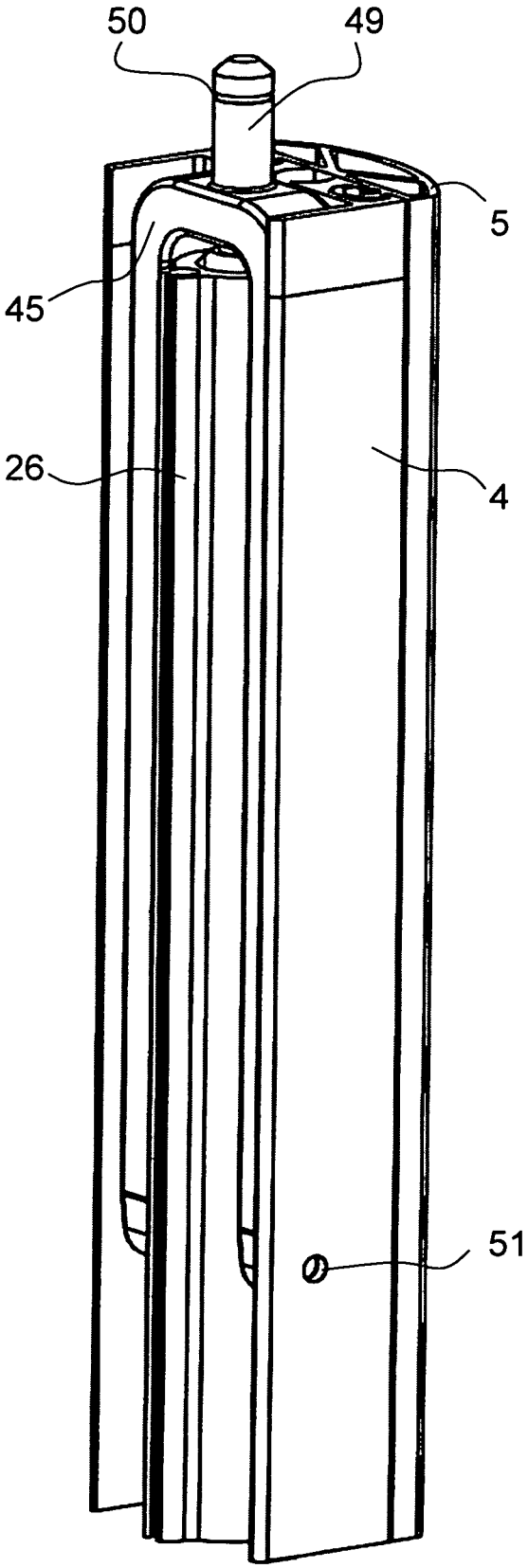
FIG. 6*a*) shows a view of the sliding bar in the vertical position; b) shows a view of the sliding bar in the tilted position.
Figure 6B:
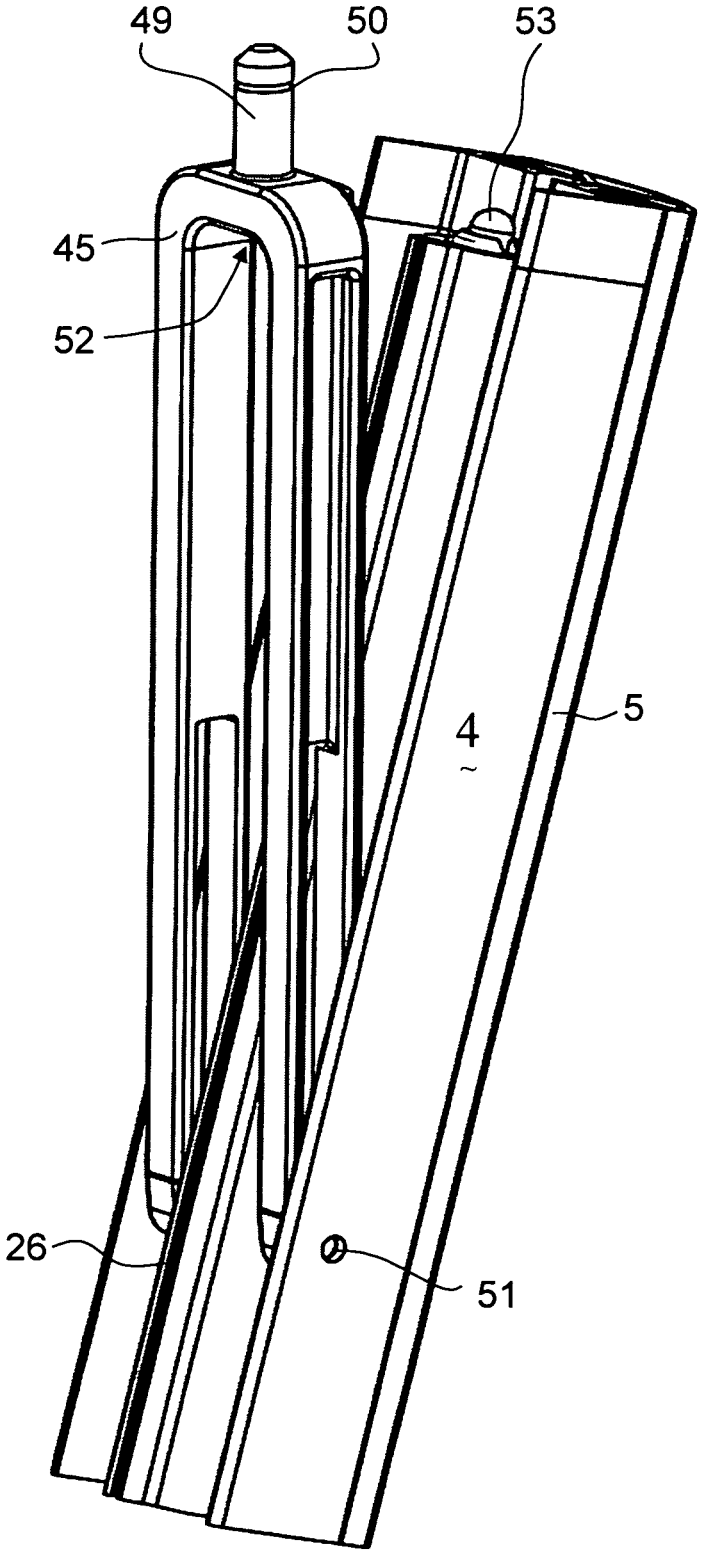

FIG. 5 shows a corresponding view in a plane perpendicular to the spindle 32. The pulling carriage 39 has at least one inner running thread 47, in which the thread of the spindle 32 engages and via which the pulling carriage 39 is displaced when the spindle 32 is rotated. FIG. 5 also illustrates the guide rail 10, and it can thus be seen how the running rollers 40/41 run in the guide rail 10. The cylinder 44 projects out through a slot 48 on the underside of the guide rail 10. The sliding bar 4 has a fork 45 which, for its part, engages in the cylinder 44 via a fastening pin 49. For this purpose, the cylinder 44 contains an inner, encircling groove which accommodates a retaining ring on the fastening pin 49, this ring being arranged in the groove designated 50 in FIG. 6*a*), when the fastening pin 49 is pushed into the cylinder 44. This ensures firm, but possibly rotatable fastening of the sliding bar 4 on the pulling carriage 39. The fork 45 is thus arranged rigidly in the vertical direction. The fork 45 is, to a certain extent, concealed in two vertically running cutouts in the profile of the sliding bar 4, these each being arranged to the sides of the fastening groove 26. At its bottom end, the fork 45 is attached to the sliding bar 4 via a pivot pin 51. As can be seen from FIG. 6*b*), this fastening of the fork 45 on the sliding bar 4 allows the sliding bar 4 to tilt if, e.g. when the door is being closed, an object is located in the inside width of the door opening. It is thus possible to prevent the situation where, for example, somebody gets caught in the door. In order nevertheless to ensure rigid fixing of the fork 45 or sliding bar 4 during normal operation, the underside of the fork 45 contains a socket 52 which, for its part, in the vertical position of the sliding bar 4, ends up located on a ball 53 which is arranged at the top end of the sliding bar 4 and is resiliently mounted via an adjustment spring. This connection thus only releases the vertical connection of the sliding bar 4 when a certain leverage is achieved about the pin 51. This force can be adjusted via the adjustment spring of the ball 53. Once the sliding bar 4 has been disengaged from its vertical position (as is illustrated in FIG. 6*b*), then it is automatically fixed in the vertical position again either when the sliding bar 4 is guided into the fully closed position or when the sliding bar 4 is displaced into the fully open position.

Figure 7:
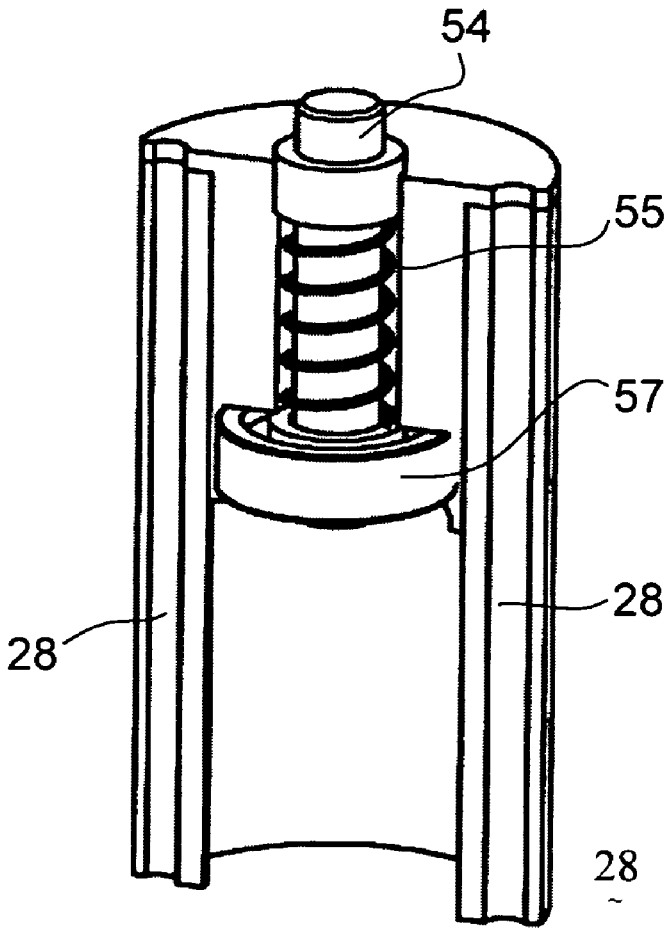
FIG. 7 shows a view of an attachment for the roller body for the textile.

FIG. 7 shows the top part of half of the roller body 28. It can be gathered here how the roller body, which is of exchangeable configuration, is mounted via a pin 54 in a bearing location arranged on the underside of the attachment plate 31. The pin 54 is mounted in a displaceable manner via an adjustment spring 55, with the result that, for exchange purposes, the roller body 28 can be pushed into the bearing location from beneath by way of the pin 54, and can then also be fixed on the underside.

Figure 8:
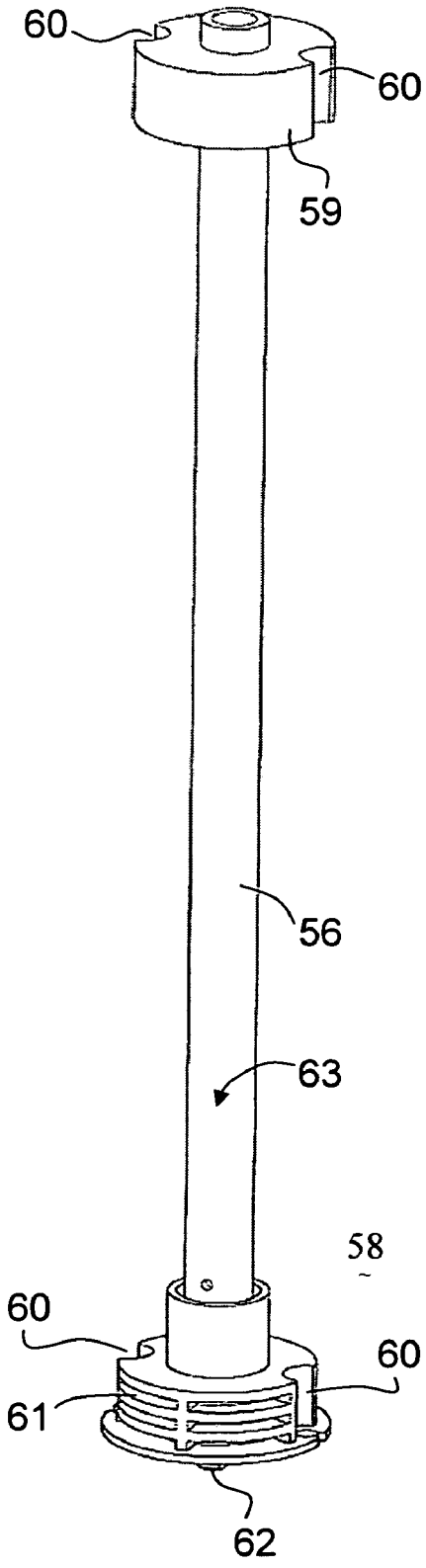
FIG. 8 shows a tube for the torsion spring of the roller body.

FIG. 8 shows the torsion-spring unit 58 of the roller body 28. This unit is pushed from beneath into the tube which is illustrated in FIG. 7. In order to be capable of accommodating the fastening grooves 29, the head part 59, for its part, has grooves 60. The torsion-spring unit 58 has a tube 56, in which a torsion spring 63 is arranged such that at its top end, in the region of the head part 59, it is connected firmly to the torsion-spring unit 58 and is otherwise rotatable in the tube 56. The torsion-spring unit 58 has, at its bottom end, a foot part 61, which likewise has grooves 60 for the fastening grooves 29. The foot part 61 terminates the tube of the roller body 28 in the downward direction. A fixing means 62 for the torsion spring 63 can likewise be gathered from this figure. This fixing means is connected firmly to the bottom end of the torsion spring 63 and can be pushed into a rotationally fixed holder in the roller casing 2. For very straightforward exchange of the roller body, which may even be carried out without tools, all that is correspondingly required is to exchange the tube with the textile door leaf fastened thereon. The torsion spring 63, on the one hand, ensures that the textile is tensioned without bunching and, on the other hand, provides the necessary emergency-opening energy.

The same components can be used to realize doors which, depending on requirements, open to the left or right. The conversion can be done in just a small number of installation steps and can be carried out by the fitter on site.

By virtue of the spindle and the guide rail 10 being cut to length, the displacement and/or the inside width can be adapted specifically to the conditions in hand. The cut-to-length parts do not require any further machining and can be installed right away. The proposed design makes it possible to realize variable door widths.

In respect of the control or power supply for individual doors, e.g. in an area with a plurality of toilet cubicles, it is recommended to work with extra-low voltage (direct-current motors are used correspondingly) and to provide one transformer for each drive group. The individual doors may be connected in series and, in respect of the power, the system may be designed that in each case only 4 doors can be closed simultaneously upon activation, for example, of 10 doors in an area. Fewer safeguarding measures thus need be taken and, as a result of just one transformer being used, the costs are reduced.

To summarize, the proposed door system has the following advantages:

Contactless, hygienic door operation

Automatic and reliable movement of the door element (without additional sensors)

Automatic emergency opening if required

Optimum movement procedure; sliding movement means that no pivoting region is necessary.

Screening

Pleasing design

The door elements do not require much space, and there is therefore more space in the cubicle Door element can be used as "rolling" advertising surface.

Flexible installation for variable installation situations (only lateral fastening). No lintel and no guidance on the floor required By virtue of a minimal door-leaf weight, it is possible to do away with safety elements external to the drive.

Straightforward replacement of existing "manually operated doors".

Hygiene as a result of being clear of the floor (floor cleaning is facilitated).

Straightforward modular construction

Adaptability to construction directly on site during installation,

The invention claimed is:

1. A rolling door comprising:

a door leaf which can be rolled up;

a vertical roller casing for taking up the door leaf in at least a partially rolled up state;

a sliding bar slidable in a horizontal direction and on which the door leaf is fastened;

a horizontal guide rail located at a top of the door leaf and in which the sliding bar is slidably mounted, wherein the roller casing is fastened on a wall by way of its rear side or its outer side, the guide rail is fastened exclusively on one side directly or indirectly on the roller casing and on the other side in a holder attached directly or indirectly to a wall and the guide rail is a hollow profile;

a pulling carriage with running rollers displaceably mounted in the hollow profile, wherein the hollow profile has a single slot which is open in a downward direction, and the pulling carriage is connected to the sliding bar through this slot; and a motor for displacing the sliding bar and located in the roller casing or on the roller casing, wherein the displacement of the sliding bar is induced by a spindle which is driven by the motor, and the spindle is arranged in an interior of the guide rail, engages in at least one internal thread in the pulling carriage and is mounted in the holder on a side which is directed away from the roller casing.

2. The rolling door as claimed in claim 1, wherein the guide rail is a tube of essentially circular cross section; and the pulling carriage has at least one pair of the running rollers arranged sideways of the pulling carriage, the rollers having a curved running surface running on inner surfaces of the tube alongside the slot.

3. The rolling door as claimed in claim 1, further comprising a counter-profile located on a side of the rolling door opposite the roller casing, wherein:

the counter-profile is fastened on a wall and stops the sliding bar when the rolling door is closed; and the holder for the guide rail is a top covering for the counter-profile and is connected thereto.

4. The rolling door as claimed in claim 1, further comprising a contactless switch for operating the rolling door, wherein the contactless switch is located on the roller casing, is arranged perpendicularly to a plane of the door leaf, and is a single switch for logical activation of the motor for opening and closing the door leaf.

5. The rolling door as claimed in claim 4, wherein the contactless switch is arranged on an inner side of the roller casing.

6. The rolling door as claimed in claim 1, wherein the roller casing includes a roller body for rolling up the door leaf, and wherein the roller body includes a torsion spring constructed such that when the door leaf is being closed, the torsion spring is unwound from the roller body against the spring force building up energy sufficient for rolling up the door leaf onto the roller body again when the rolling door is opened.

7. The rolling door as claimed in claim 6, wherein the door leaf and the roller body are exchangeable, and are formed from an at least partially textile woven fabric.

8. The rolling door as claimed in claim 1, wherein:

the guide rail is a tube of essentially circular cross section, and the pulling carriage has two pairs of running rollers arranged one behind the other and sideways of the pulling carriage, which running rollers have a curved running surface and running on inner surfaces of the tube alongside the slot.

9. A rolling door comprising:

a door leaf which can be rolled up;

a vertical roller casing for taking up the door leaf in at least a partially rolled up state;

a sliding bar slidable in a horizontal direction and on which the door leaf is fastened;

a horizontal guide rail located at a top of the door leaf and in which the sliding bar is slidably mounted by way of a pulling carriage, wherein the roller casing is fastened on a wall by way of its rear side or its outer side, the guide rail is fastened exclusively on one side directly or indirectly on the roller casing and on the other side in a holder attached directly or indirectly to a wall, the sliding bar includes a mechanism for allowing the sliding bar to tilt if an obstacle is located in an inside width of the door and when the rolling door is being closed, the mechanism is a bar or fork arranged vertically and connected rigidly to the pulling carriage and is attached to the sliding bar via a pivot pin, the pivot pin arranged perpendicularly to the door leaf and located in the sliding bar, and means for fixing the sliding bar in a vertical position and for releasing the sliding bar such that it can be rotated about the pivot pin when a certain leverage about the pivot pin is exceeded.

10. The rolling door as claimed in claim 9, wherein:

the guide rail has a hollow profile; and the pulling carriage has running rollers displaceably mounted in the hollow profile, wherein the hollow profile has a single slot which is open in a downward direction, and the pulling carriage is connected to the sliding bar through this slot.

11. The rolling door as claimed in claim 10, wherein:

the guide rail is a tube of essentially circular cross section; and the pulling carriage has at least one pair of the running rollers arranged sideways of the pulling carriage, the rollers having a curved running surface running on inner surfaces of the tube alongside the slot.

12. The rolling door as claimed in claim 10, further including a motor for displacing the sliding bar and located in the roller casing or on the roller casing, wherein the displacement of the sliding bar is induced by a spindle which is driven by the motor, and the spindle is arranged in an interior of the guide rail, engages in at least one internal thread in the pulling carriage and is mounted in the holder on a side which is directed away from the roller casing.

13. The rolling door as claimed in claim 9, further comprising a counter-profile located on a side of the rolling door opposite the roller casing, wherein:

the counter-profile is fastened on a wall and stops the sliding bar when the rolling door is closed; and the holder for the guide rail is a top covering for the counter-profile and is connected thereto.

14. The rolling door as claimed in claim 9, further comprising a contactless switch for operating the rolling door, wherein the contactless switch is located on the roller casing, is arranged perpendicularly to a plane of the door leaf, and is a single switch for logical activation of the motor for opening and closing the door leaf.

15. The rolling door as claimed in claim 14, wherein the contactless switch is arranged on an inner side of the roller casing.

16. The rolling door as claimed in claim 9, wherein the roller casing includes a roller body for rolling up the door leaf, and wherein the roller body includes a torsion spring constructed such that when the door leaf is being closed, the torsion spring is unwound from the roller body against the spring force building up energy sufficient for rolling up the door leaf onto the roller body again when the rolling door is opened.

17. The rolling door as claimed in claim 16, wherein the door leaf and the roller body are exchangeable, and are formed from an at least partially textile woven fabric.

18. The rolling door as claimed in claim 9, wherein:

the guide rail is a tube of essentially circular cross section, and the pulling carriage has two pairs of running rollers arranged one behind the other and sideways of the pulling carriage, which running rollers have a curved running surface and running on which inner surfaces of the tube alongside the slot.

* * * * *